United States Patent [19]

Broker et al.

[11] Patent Number: 4,457,745

[45] Date of Patent: Jul. 3, 1984

[54] CENTRIFUGE WITH A BELT-DRIVEN SPINDLE

[75] Inventors: Klaus D. Broker; Paul Bruning, both of Oelde; Eberhard Wenzel, Langenberg, all of Fed. Rep. of Germany

[73] Assignee: Westfalia Separator AG, Oelde, Fed. Rep. of Germany

[21] Appl. No.: 389,639

[22] Filed: Jun. 18, 1982

[30] Foreign Application Priority Data

Jul. 1, 1981 [DE] Fed. Rep. of Germany ..... 3125832

[51] Int. Cl.[3] ..... B04B 15/00

[52] U.S. Cl. ..... 494/15; 494/83

[58] Field of Search ..... 494/15, 46, 82, 83, 494/84, 85

[56] References Cited

U.S. PATENT DOCUMENTS 1,745,853 2/1930 Krantz ..... 494/83

FOREIGN PATENT DOCUMENTS 1031222 5/1958 Fed. Rep. of Germany .

*Primary Examiner*—Robert W. Jenkins
*Assistant Examiner*—Arthur D. Dahlberg
*Attorney, Agent, or Firm*—Sprung, Horn, Kramer & Woods

[57] ABSTRACT

A centrifuge with a drive-mechanism that incorporates a vertical spindle mounted on ball or roller bearings and driven by a belt in such a way as to rotate while aligning itself in space around a point of attachment on its longitudinal axis with respect to the framework of the centrifuge and with respect to a bearing housing that is supported on the framework. The midplane of the drive belt extends through the point of attachment, with which the center of mass of the self-aligning components also coincide. The overall length of the spindle is short. The ratio L/D of the distance L between the bearings to the diameter D of the bearings ranges from approximately 0 to 2.

13 Claims, 5 Drawing Figures

CENTRIFUGE WITH A BELT-DRIVEN SPINDLE

BACKGROUND OF THE INVENTION

The present invention relates to a centrifuge with a drive-mechanism that incorporates a vertical spindle mounted on at least one bearing in such a way as to rotate while aligning itself in space around a point of attachment on its longitudinal axis with respect to the framework of the centrifuge and with respect to a bearing housing that is supported on the framework, with the spindle driven by a belt.

A centrifuge of this type in which the V-belt pulley that powers the spindle is mounted under the step bearing, so that the midplane of the belt drive is below the bearing, is known from German Auslegeschrift No. 1 031 222. One drawback to this device however is that the forces applied to the spindle by the pull of the belt tend to skew it. Another is that the self-aligning emplacement of the spindle, which consists of a number of small parts, helical springs distributed around the neck bearing and a resilient support and a bearing ring at the step bearing, is expensive. Furthermore, since the distance between the step and neck bearings is long, the spindle must be so lengthy that its mass will have an excessive effect when the machine is in operation.

SUMMARY OF THE INVENTION

The main object of the present invention is to provide a centrifuge of the type initially described, in which the belt pull does not skew the spindle and that has an inexpensive drive mechanism and a short spindle.

The invention fulfills this objective because the point of attachment of the drive mechanism is either in the vicinity of the bearing if there is only one or between the upper and lower bearings if there are two, because the center of mass of the self-aligning components of the drive mechanism coincides with the point of attachment or is situated in its vicinity, because the ratio L/D of the distance L between bearings to the diameter D of the bearing or to the mean of different bearing diameters ranges approximately from 0 to 2, and because the midplane of the belt drive extends through the point of attachment or is situated in its vicinity.

This design for a centrifuge drive mechanism considerably diminishes the effect of the mass of the spindle. Drums that are much heavier than have previously been possible to employ but with equivalent running properties, and drums that can rotate at different rates, can be used. Furthermore, since shorter spindles are more rigid they can also have smaller diameters.

Fastening a metal Bourdon tube, which has one end attached to the framework of the centrifuge and has perforated slits across its longitudinal axis, to the housing that accommodates the bearing or bearings is also practical. This Bourdon tube can however also be employed with longer spindles.

Further properties and characteristics of the invention will be evident, from the following specification of embodiments of the invention, with reference to the drawings, in which:

DETAILED DESCRIPTION OF THE PREFERRED EMBODIMENTS

Figure 1:
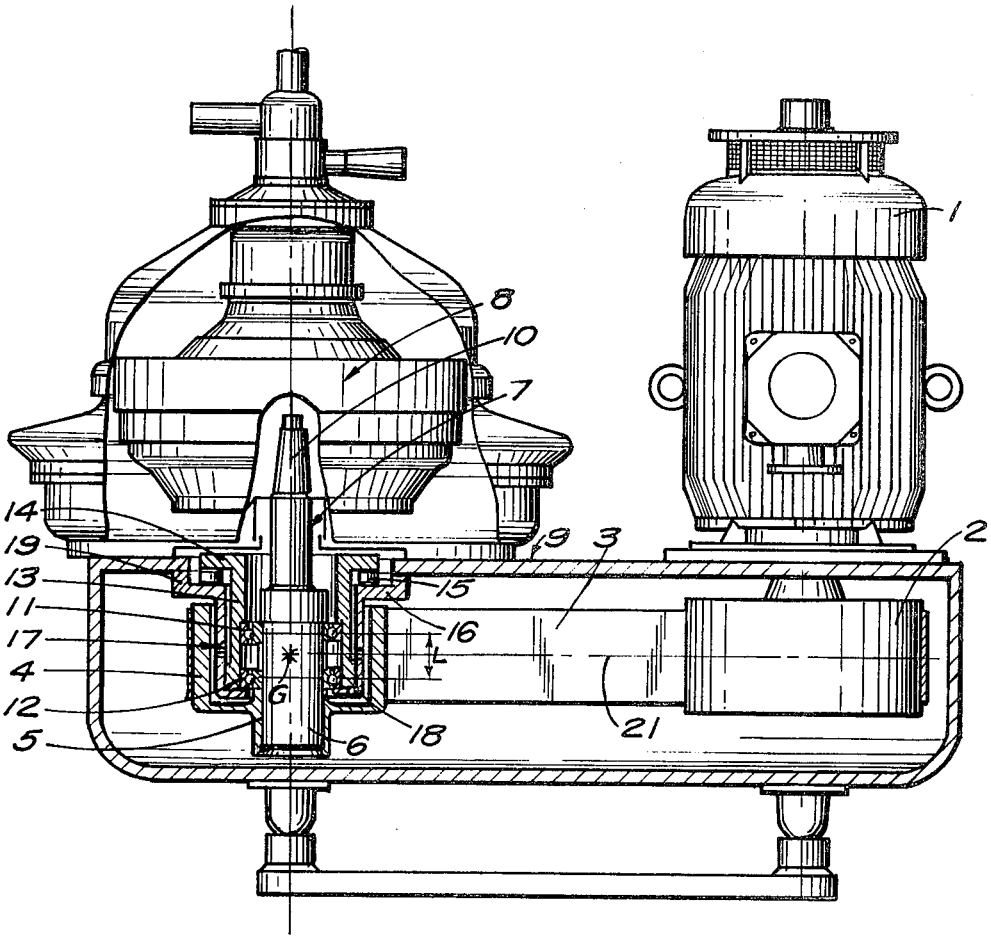
FIG. 1 is an elevation in partial section of a centrifuge according to the invention.
Figure 3:
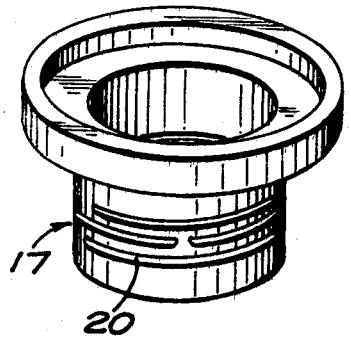
FIG. 3 is a perspective drawing of the Bourdon tube that is attached to the bearing housing and to the framework of the centrifuge.

The centrifuge 8 in FIG. 1 is powered by a motor 1 with a shaft on which is mounted a belt pulley 2 that drives a second belt pulley 4 through a belt 3. The hub 5 of driven pulley 4 is fixed to the bottom 6 of a vertical spindle 7. Spindle 7 is mounted in such a way as to rotate while aligning itself in space around a point G of attachment on its longitudinal axis 10 with respect to the framework 9 of the centrifuge. The point G of attachment in the embodiment shown in FIG. 1 is situated between an upper and a lower ball or roller bearing 11, 12 rspectively. The outer race of each bearing is accommodated in a housing 13 that has an upper flange 14 that rests through intermediate absorbers 15 distributed around its circumference on the upper flange 16 of a metal Bourdon tube 17. The bottom of Bourdon tube 17 has an annular component 18 that is fastened to bearing housing 13 and flanges the lower bearing 12. The upper flange 16 of Bourdon tube 17 has an angular cross-section and has an annular component 19 that is fastened to centrifuge framework 9. Bourdon tube 17, as shown in FIG. 3, also has perforated slits 20 across its longitudinal axis. Its spring characteristic is soft along the axis and very hard radially. The Bourdon tube is not subject to wear, is maintenance-free, and can take high temperatures like those produced by friction in the bearings.

The center of mass of the self-aligning drive components coincides with point G of attachment or is situated in its vicinity. The ratio L/D of the distance L between ball or roller bearings 11, 12 to the diameter D of the bearings or to the mean of different bearing diameters ranges from approximately 0 to 2.

As will be evident from FIG. 1, the midplane 21 of the belt drive extends through point G of attachment.

Belt pulley 4, which is attached to the spindle 7 and encompasses almost the total length of Bourdon tube 17, also serves as a reservoir for the oil that serves to lubricate the bearing system. Although this hot oil is applied to Bourdon tube 17, it will not, since it does not come into contact with absorbers 15, have a deleterious effect on their life if they are made of rubber or of another oil-sensitive material.

Figure 2:
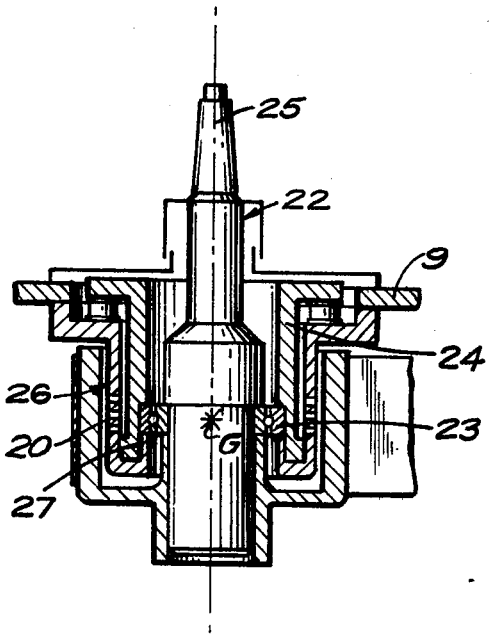
FIG. 2 is a partial section of another embodiment of the invention with a drive in which the spindle is mounted in its associated housing with only one bearing.

In the embodiment illustrated in FIG. 2, spindle 22 is mounted with only one ball or roller bearing 23 in a bearing housing 24. Point G of attachment, around which spindle 22 aligns itself, is situated in the vicinity of bearing 23 on the longitudinal axis 25 of the spindle. An annular inner component 27 of the Bourdon tube 26 is attached to bearing housing 24 and is flanged to ball or roller bearing 23 and an annular outer component is attached to centrifuge framework 9.

Figure 4:
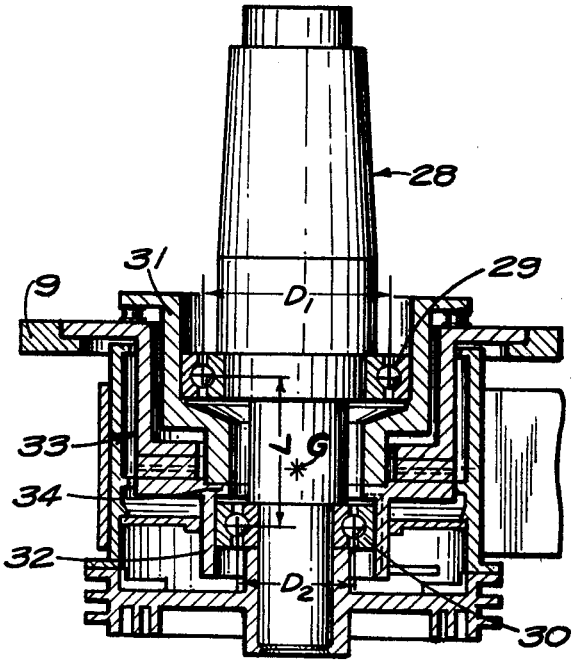
FIG. 4 is a partial section of still another embodiment of the invention in which the bearings have different diameters.

In the embodiment illustrated in FIG. 4, a ball or roller bearing 29 with a large diameter D1 and a smaller ball or roller bearing 30 with a diameter D2 support spindle 28 in a bearing housing 31 and in the lower annular component 32 of a Bourdon tube 33. There is a flange 34 that extends inward above annular component 32 on Bourdon tube 33 and that is connected to bearing housing 31. This mechanism has a short spindle as well as a short distance L between ball or roller bearings 29 and 30.

Figure 5:
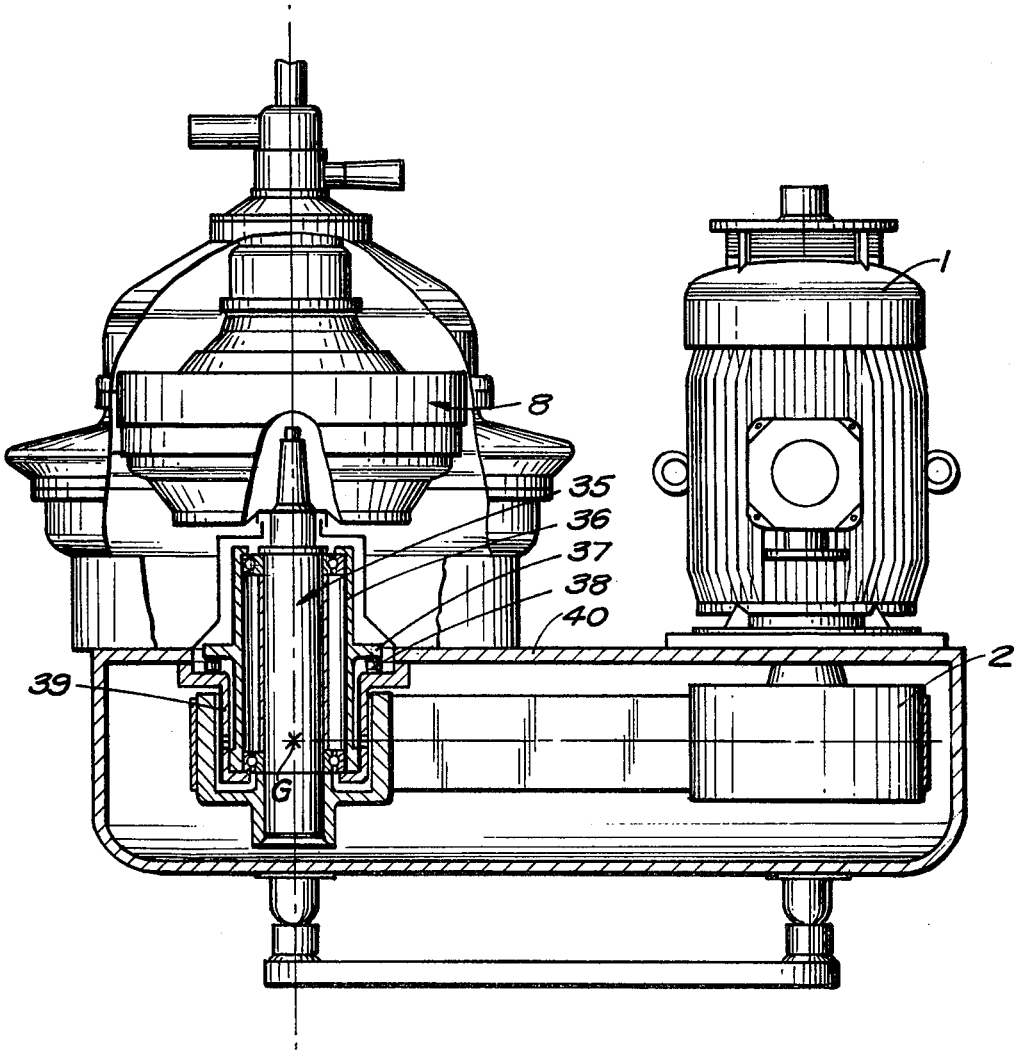
FIG. 5 is a partial section of yet another embodiment of the invention with a longer spindle.

The centrifugal drive mechanism illustrated in FIG. 5 has a longer spindle 35. The flange 37 on the bearing housing 36 associated with this spindle is supported through the intermediary of absorbers 38 on a Bourdon tube 39 of which the top is attached to centrifuge framework 40 and the bottom to bearing housing 36.

It will be evident from FIGS. 1, 2 and 5 that point G of attachment is in the vicinity of perforated slits 20.

It will be appreciated that the instant specification and claims are set forth by way of illustration and not limitation, and that various modifications and changes may be made without departing from the spirit and scope of the present invention.

What is claimed is:

1. In a centrifuge having a frame, a drive-mechanism including a vertical spindle having a longitudinal axis, means including at least one bearing for rotatably mounting the spindle for self-alignment in space around a given point along the longitudinal axis of the spindle with respect to the frame of the centrifuge and a bearing housing supported on the frame and a belt for driving the spindle and having a midplane, the improvement wherein the mounting means includes means disposing the given point in the vicinity of the bearing, wherein the center of mass of the mounting means is situated in the vicinity of the given point and wherein the midplane of the drive belt extends in the vicinity of the given point.

2. The centrifuge according to claim 1, wherein the mounting means comprises at least two bearings, wherein the given point is between the two bearings and the ratio of the distance between the bearings to the mean of the bearing diameters is approximately 0 to 2.

3. The centrifuge according to claim 1 or claim 2, wherein the center of mass coincides with the given point.

4. The centrifuge according to claim 3, wherein the midplane of the drive belt extends through the given point.

5. The centrifuge according to claim 2, wherein the mounting means further comprises a metal Bourdon tube having one end attached to the frame of the centrifuge, perforated slits perpendicular to the longitudinal axis thereof and a lower annular portion at the other end in which the outer ring of the lower bearing is mounted.

6. The centrifuge according to claim 1, wherein the mounting means further comprises a metal Bourdon tube having one end attached to the frame of the centrifuge, perforated slits perpendicular to the longitudinal axis thereof and the other end attached to the bearing housing.

7. The centrifuge according to claim 5 or 6, wherein the Bourdon tube has an upper flange at said one end and the bearing housing is resiliently supported at the upper portion thereof on the upper flange of the Bourdon tube.

8. The centrifuge according to claim 7, wherein the upper portion of the bearing housing has an upper flange and wherein absorbers are distributed around its circumference to resiliently support it against the upper flange of the Bourdon tube.

9. The centrifuge according to claim 8, wherein the upper flange of the Bourdon tube has an angular cross-section and has an annular component that is fastened to the centrifuge frame.

10. The centrifuge according to claim 8, further comprising a belt pulley attached to the spindle and forming a reservoir for lubricating oil and wherein the absorbers are disposed outside the path of the lubricating oil.

11. The centrifuge according to claim 5 or 6, wherein the given point is in the vicinity of the perforated slits.

12. The centrifuge according to claim 1 or claim 2, wherein the midplane of the drive belt extends through the given point.

13. The centrifuge according to claim 1, further comprising a belt pulley attached to the spindle and forming a reservoir for lubricating oil.

* * * * *